US005703627A

United States Patent [19]

Young

[11] Patent Number: 5,703,627

[45] Date of Patent: Dec. 30, 1997

[54] METHOD FOR COLORFLASH REDUCTION BY COPYING COLOR VALUES BETWEEN ACTIVE AND INACTIVE WINDOW APPLICATIONS SO AS TO MINIMIZE DIFFERING COLOR CELLS BETWEEN CORRESPONDING COLOR MAPS

[75] Inventor: James A. Young, San Jose, Calif.

[73] Assignee: Apple Computer, Inc., Cupertino, Calif.

[21] Appl. No.: 670,537

[22] Filed: Jun. 27, 1996

Related U.S. Application Data

[63] Continuation of Ser. No. 400,974, Mar. 8, 1995, abandoned.

[51] Int. Cl.[6] ..... G09G 5/06

[52] U.S. Cl. ..... 345/199; 345/186; 345/150; 395/131; 395/343; 395/334

[58] Field of Search ..... 345/199, 150, 345/186, 152, 119, 22; 395/131, 129, 130, 340, 343, 346, 334

[56] References Cited

U.S. PATENT DOCUMENTS

| | | | |
|---|---|---|---|
| 4,847,604 | 7/1989 | Doyle | 345/180 |
| 5,226,117 | 7/1993 | Miklos | 395/157 |
| 5,388,993 | 2/1995 | McKiel et al. | 345/156 |
| 5,406,310 | 4/1995 | Aschenbrenner et al. | 345/150 |
| 5,424,754 | 6/1995 | Bar et al. | 345/150 |
| 5,428,721 | 6/1995 | Sato et al. | 395/133 |
| 5,430,465 | 7/1995 | Sabella et al. | 345/150 |

*Primary Examiner*—Mark R. Powell
*Assistant Examiner*—Martin Loui
*Attorney, Agent, or Firm*—Burns, Doane, Swecker & Mathis, LLP

[57] ABSTRACT

A method for reducing colorflashing by performing residual color allocation and default colormap sharing in a computer system that employs a default colormap to display color. The residual color allocation technique copies color values from a private colormap into corresponding non-allocated (free) cells within the computer system default colormap. While copying into the free cells in the default colormap the free cells are temporarily set to have an allocated status. After copying, the copied cells are reset to a free status. In this way, other clients may allocate the default map's free cells to perform residual colormap allocation. Since the default colormap's copied cells are the same as corresponding cells in the private map they do not flash when switching color focus between the default colormap and the private colormap. The default colormap sharing technique is employed in the case in which a private colormap does not require a specific set of colors, and can adapt to a given set of colors. Default colormap sharing is performed by copying allocated cell color values from the default colormap to corresponding cell locations within the private colormap. The residual color allocation and default colormap sharing techniques may be implemented when a given client (which uses a private colormap) creates/defines the color values in its corresponding private map. This generally occurs when the client's corresponding application window is opened. The technique of the present invention may be subsequently implemented when clients redefine colors within their corresponding private colormaps.

15 Claims, 4 Drawing Sheets

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | 0xffff | 0xffff | 0x000 |
| 5 | 0xffff | 0x0000 | 0xffff |
| 6 | 0x0000 | 0xffff | 0xffff |
| 7 | 0x0 | 0x8888 | 0x0 |
| 8 | 0x0 | 0x0 | 0x8888 |
| . | . | . | . |
| . | . | . | . |
| N-2 | 0x0 | 0xffff | 0xffff |
| N-1 | 0x0 | 0x0 | 0x0 |

CLIENT PRIVATE COLORMAP

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | 0xbbbb | 0xbbbb | 0xbbbb |
| 5 | 0xaaaa | 0xaaaa | 0xaaaa |
| 6 | 0x8888 | 0x0 | 0x0 |
| 7 | 0x0 | 0x8888 | 0x0 |
| 8 | 0x0 | 0x0 | 0x8888 |
| 9 | 0x8888 | 0x8888 | 0x0 |
| . | . | . | . |
| . | . | . | . |
| N-2 | 0x0 | 0xffff | 0xffff |
| N-1 | 0x0 | 0x0 | 0x0 |

FIG_3A

DEFAULT COLORMAP

| FREE | RED | GREEN | BLUE |
|---|---|---|---|
| n | -- | -- | -- |
| n | -- | -- | -- |
| n | -- | -- | -- |
| n | -- | -- | -- |
| y | undef | undef | undef |
| y | undef | undef | undef |
| y | undef | undef | undef |
| n | -- | -- | -- |
| n | -- | -- | -- |
| y | undef | undef | undef |
| y | . | . | . |
| y | . | . | . |
| y | undef | undef | undef |
| y | undef | undef | undef |

FIG_3B

CLIENT PRIVATE COLORMAP

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | 0xbbbb | 0xbbbb | 0xbbbb |
| 5 | 0xaaaa | 0xaaaa | 0xaaaa |
| 6 | 0x8888 | 0x0 | 0x0 |
| 7 | 0x0 | 0x8888 | 0x0 |
| 8 | 0x0 | 0x0 | 0x8888 |
| 9 | 0x8888 | 0x8888 | 0x0 |
| . | . | . | . |
| . | . | . | . |
| N-2 | 0x0 | 0xffff | 0xffff |
| N-1 | 0x0 | 0x0 | 0x0 |

FIG_4A

DEFAULT COLORMAP

| FREE | RED | GREEN | BLUE |
|---|---|---|---|
| n | -- | -- | -- |
| n | -- | -- | -- |
| n | -- | -- | -- |
| n | -- | -- | -- |
| X | 0xbbbb | 0xbbbb | 0xbbbb |
| X | 0xaaaa | 0xaaaa | 0xaaaa |
| X | 0x8888 | 0x0 | 0x0 |
| n | -- | -- | -- |
| n | -- | -- | -- |
| X | 0x8888 | 0x8888 | 0x0 |
| . | . | . | . |
| . | . | . | . |
| X | 0x0 | 0xffff | 0xffff |
| X | 0x0 | 0x0 | 0x0 |

FIG_4B

CLIENT PRIVATE COLORMAP

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | 0xbbbb | 0xbbbb | 0xbbbb |
| 5 | 0xaaaa | 0xaaaa | 0xaaaa |
| 6 | 0x8888 | 0x0 | 0x0 |
| 7 | 0x0 | 0x8888 | 0x0 |
| 8 | 0x0 | 0x0 | 0x8888 |
| 9 | 0x8888 | 0x8888 | 0x0 |
| • | • | • | • |
| • | • | • | • |
| N-2 | 0x0 | 0xffff | 0xffff |
| N-1 | 0x0 | 0x0 | 0x0 |

FIG_5A

DEFAULT COLORMAP

| FREE | RED | GREEN | BLUE |
|---|---|---|---|
| n | -- | -- | -- |
| n | -- | -- | -- |
| n | -- | -- | -- |
| n | -- | -- | -- |
| y | 0xbbbb | 0xbbbb | 0xbbbb |
| y | 0xaaaa | 0xaaaa | 0xaaaa |
| y | 0x8888 | 0x0 | 0x0 |
| n | -- | -- | -- |
| n | -- | -- | -- |
| y | 0x8888 | 0x8888 | 0x0 |
| • | • | • | • |
| • | • | • | • |
| y | 0x0 | 0xffff | 0xffff |
| y | 0x0 | 0x0 | 0x0 |

FIG_5B

CLIENT PRIVATE COLORMAP

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | -- | -- | -- |
| 5 | -- | -- | -- |
| 6 | -- | -- | -- |
| 7 | 0x0 | 0x8888 | 0x0 |
| 8 | 0x0 | 0x0 | 0x8888 |
| 9 | -- | -- | -- |
| • | -- | -- | -- |
| • | -- | -- | -- |
| N-2 | -- | -- | -- |
| N-1 | -- | -- | -- |

FIG_6A

DEFAULT COLORMAP

| FREE | RED | GREEN | BLUE |
|---|---|---|---|
| n | 0x00ff | 0x0 | 0x0 |
| n | 0x0 | 0x00ff | 0x0 |
| n | 0x0 | 0x0 | 0x00ff |
| n | 0x00ff | 0x00ff | 0x0 |
| y | -- | -- | -- |
| y | -- | -- | -- |
| y | -- | -- | -- |
| n | 0x0 | 0x00aa | 0x00bb |
| n | 0x00bb | 0x00aa | 0x0 |
| y | -- | -- | -- |
| y | -- | -- | -- |
| y | -- | -- | -- |
| y | -- | -- | -- |
| y | -- | -- | -- |

FIG_6B

CLIENT PRIVATE COLORMAP

| PIXEL | RED | GREEN | BLUE |
|---|---|---|---|
| 0 | 0x00ff | 0x0 | 0x0 |
| 1 | 0x0 | 0x00ff | 0x0 |
| 2 | 0x0 | 0x0 | 0x00ff |
| 3 | 0x00ff | 0x00ff | 0x0 |
| 4 | -- | -- | -- |
| 5 | -- | -- | -- |
| 6 | -- | -- | -- |
| 7 | 0x0 | 0x00aa | 0x00bb |
| 8 | 0x00bb | 0x00aa | 0x0 |
| 9 | -- | -- | -- |
| • | -- | -- | -- |
| • | -- | -- | -- |
| N-2 | -- | -- | -- |
| N-1 | -- | -- | -- |

FIG_7A

DEFAULT COLORMAP

| FREE | RED | GREEN | BLUE |
|---|---|---|---|
| n | 0x00ff | 0x0 | 0x0 |
| n | 0x0 | 0x00ff | 0x0 |
| n | 0x0 | 0x0 | 0x00ff |
| n | 0x00ff | 0x00ff | 0x0 |
| y | -- | -- | -- |
| y | -- | -- | -- |
| y | -- | -- | -- |
| n | 0x0 | 0x00aa | 0x00bb |
| n | 0x00bb | 0x00aa | 0x0 |
| y | -- | -- | -- |
| y | -- | -- | -- |
| y | -- | -- | -- |
| y | -- | -- | -- |
| y | -- | -- | -- |

FIG_7B

CLIENT PRIVATE COLORMAP

| PIXEL | RED | GREEN | BLUE |
|---|---|---|---|
| 0 | 0xffff | 0xffff | 0xffff |
| 1 | 0xeeee | 0xeeee | 0xeeee |
| 2 | 0xdddd | 0xdddd | 0xdddd |
| 3 | 0xcccc | 0xcccc | 0xcccc |
| 4 | 0xbbbb | 0xbbbb | 0xbbbb |
| 5 | 0xaaaa | 0xaaaa | 0xaaaa |
| 6 | 0x8888 | 0x0 | 0x0 |
| 7 | 0x0 | 0x8888 | 0x0 |
| 8 | 0x0 | 0x0 | 0x8888 |
| 9 | 0x8888 | 0x8888 | 0x0 |
| • | • | • | • |
| • | • | • | • |
| N-2 | 0x0 | 0xffff | 0xffff |
| N-1 | 0x0 | 0x0 | 0x0 |

FIG_8A

DEFAULT COLORMAP

| FREE | RED | GREEN | BLUE |
|---|---|---|---|
| n | 0xffff | 0xffff | 0xffff |
| n | 0xeeee | 0xeeee | 0xeeee |
| n | 0xdddd | 0xdddd | 0xdddd |
| n | 0xcccc | 0xcccc | 0xcccc |
| y | 0xbbbb | 0xbbbb | 0xbbbb |
| y | 0xaaaa | 0xaaaa | 0xaaaa |
| y | 0x8888 | 0x0 | 0x0 |
| n | 0x0 | 0x8888 | 0x0 |
| n | 0x0 | 0x0 | 0x8888 |
| y | 0x8888 | 0x8888 | 0x0 |
| y | • | • | • |
| y | • | • | • |
| y | 0x0 | 0xffff | 0xffff |
| y | 0x0 | 0x0 | 0x0 |

FIG_8B

METHOD FOR COLORFLASH REDUCTION BY COPYING COLOR VALUES BETWEEN ACTIVE AND INACTIVE WINDOW APPLICATIONS SO AS TO MINIMIZE DIFFERING COLOR CELLS BETWEEN CORRESPONDING COLOR MAPS

This application is a continuation of application Ser. No. 08/400,974, filed Mar. 8, 1995 now abandoned.

FIELD OF THE INVENTION

The present invention relates to a technique for displaying color on a computer display screen and particularly for maintaining color fidelity in a computer system supporting more than one colormap.

BACKGROUND OF THE INVENTION

In a computer system that utilizes the commonly known "windowing" technique, each window utilizes a color table to determine the manner in which color is displayed on the computer screen. In general, each window, or client, displayed on the computer screen corresponds to a different software application that the computer's operating system is running. Generally, the computer's window management software (referred to as the server) can support multiple windows at one time, and thus, is capable of supporting multiple software color tables. Each window may or may not have its own unique (i.e. private) colormap.

A color table (or colormap) is an indexed look-up table made-up of rows of color cells and columns that correspond to fields within each cell. Each color cell corresponds to a particular color for the colormap. Thus, for many common types of colormaps, the number of cells of a colormap corresponds to the number of unique colors provided by the colormap. The fields of a color cell store digital color values corresponding to particular colors, such as red, green, and blue, (i.e. RGB). The combination of these color values define the unique color for that cell.

Commonly, colormaps are classified into two types: a default colormap and a private colormap. A default colormap is a colormap that is provided by the computer system. It is guaranteed to exist as long as the windows are being displayed on the screen by the system. Many clients allocate out, i.e. reserve, cells from the default colormap. In addition, many clients will not run if they cannot allocate any entries in the default colormap. For this reason, default colormaps are often set-up so as to leave as many cells free (or unallocated). Color cells within the default colormap may be allocated as read-only, or read-write. Read-only cells may be shared amongst all of the clients, whereas read-write color cells can not be shared.

When a client requires read-write access to more color cells than there are free cells in the default colormap, the client creates a colormap for private use. The client can then store colors it needs into any cell of the private colormap. When the private colormap is installed into the computer system's colormap hardware, the colors displayed on the screen are defined by this private colormap.

The clients who have their colormap installed are said to have colormap focus. One manner in which a given application (having a private colormap) gains color focus is by the having the user drag the screen cursor within the application's window and initiate interaction with it (referred to as user focus). At this time, the application's colormap is loaded into the hardware colormap of the system by the operating system's window management application. Once the application's software colormap is loaded into the system's hardware colormap, the application has color focus. In the case in which multiple applications are sharing a default colormap, all of these applications are said to have color focus, even though the user is not interacting with every application window at once. Thus, an application can have color focus, even though it does not have user focus. In another type of system, color focus is obtained when the user directly specifies within the window management application that color focus is to be given to a particular application.

In the case in which the number of colors requested to be concurrently displayed on the screen is more than the underlying hardware can support, a phenomenon referred to as "colorflash" occurs. For example, if the hardware supports a single 256 entry colormap, (meaning, at most, one 256 entry colormap can be installed at a time), then at most 256 unique colors can be displayed at one time on the display. As a consequence, only one 256 entry colormap can be installed at a time. The clients who have color focus will display in the expected colors within their corresponding windows, however, the clients who's colormap is not installed will display unexpected colors within their corresponding windows. If color focus transfers between two different colormaps certain areas within the screen will appear to suddenly flash to different colors. When color focus is transferred between colormaps having a majority of similar color cells minimal colorflashing is exhibited. However, when colormaps significantly differ, then colorflash is prominent. What is needed is a manner in which colorflashing is reduced when changing color focus between clients using different colormaps.

SUMMARY OF THE INVENTION

The present invention is a colorflash reduction technique. This technique is applicable to a computer system in which the system is displaying multiple application (i.e. client) windows and is supporting multiple client colormaps to display color on the system's screen and in a system in which many clients share a common (i.e. default) colormap.

In the first technique of the present invention, referred to as residual color allocation, the client initially allocates free cells in a shared default colormap as read-write cells. Next, color values from the color cells in the client's private colormap are copied into the allocated read-write cells in the shared default colormap at corresponding index locations. After copying, the allocated read-write cells are freed again for other clients to allocate. Cells that have been allocated and copied do not flash when changing color focus between the private colormap and the shared default colormap until either of the cells (private or default) are changed.

The second technique of the present invention is referred to as default colormap sharing. This technique is most useful when employed in the case in which a private colormap does not require a specific set of colors, and can adapt to a given set of colors. In this case, the color values stored in allocated cells in the shared default colormap are copied into corresponding index locations within the private colormap. As a result these copied cells will not colorflash when color focus changes between the private and shared default colormaps.

Finally, the third technique of the present invention simultaneously employs the above described residual color allocation and default colormap sharing techniques described above. All three of these techniques may be performed such that a client may synchronize and resynchronize color tables at any time. The colorflash reduction techniques may be implemented by explicitly selecting a menu option while in a client application having a private map or may implicitly be implemented when color focus changes to the client having a private colormap.

BRIEF DESCRIPTION OF THE DRAWINGS

FIG. 3A illustrates a client's private colormap and FIG. 3B illustrates a shared default colormap before performing one technique of residual color allocation as described by the present invention.

FIG. 4A illustrates the client's private colormap shown in FIG. 3A and FIG. 4B illustrates the shared default colormap shown in FIG. 3B while implementing one technique of residual color allocation as described by the present invention.

FIG. 5A illustrates the client's private colormap shown in FIG. 3A and FIG. 5B illustrates the shared default colormap shown in FIG. 3B after performing one technique of residual color allocation as described by the present invention.

FIG. 6A illustrates the client's private colormap and FIG. 6B illustrates a default colormap before performing one technique of default colormap sharing as described by the present invention.

FIG. 7A illustrates the client's private colormap shown in FIG. 6A and FIG. 7B illustrates the shared default colormap shown in FIG. 6B after performing one technique of default colormap sharing as described by the present invention.

FIG. 8 illustrates private and default colormaps after both the default colormap sharing and the residual color allocation techniques of the present invention has been performed.

DETAILED DESCRIPTION

Figures 1, 2:
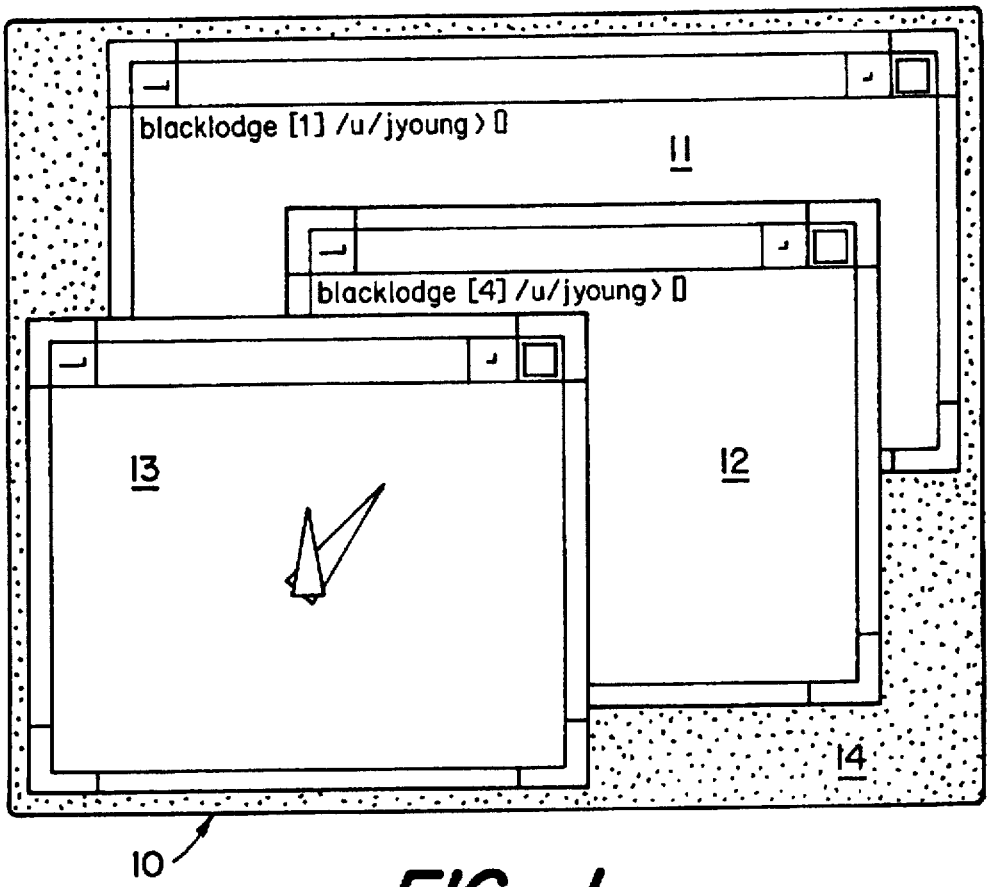
FIG. 1 illustrates a computer screen displaying multiple client windows and other areas within a display screen.
FIG. 2 is an example of a colormap.

A colorflash reduction technique is described. In the following description, numerous specific details are set forth, such as color system types, specific operating systems, color value bit width, etc., in order to provide a thorough understanding of the present invention. It will be obvious, however, to one skilled in the art that these specific details need not be employed to practice the present invention. In other instances, well-known computer system color hardware and operating systems have not been described in detail in order to avoid unnecessarily obscuring the present invention.

FIG. 1 shows a computer system display screen 10 displaying several windows, 11–13. The computer system's underlying operating system, in addition to a window management application and the systems hardware colormap, cooperate together to determine the manner in which the windows (and particularly the colors of the windows) are displayed on the screen. The hardware color table functions to store a software colormap. The software colormap currently stored in the systems hardware color table defines the manner in which color is displayed on the screen. The system's window management software is responsible for loading the designated software colormap into the hardware color table.

When a particular application has its colormap loaded into the hardware colormap it is said to have color focus. Often times, the system provides a default colormap which is shared by more than one application. Consequently, many applications can have color focus at the same time. For example, each of application windows 11 and 12 may use the default colormap and thus, if the default colormap is loaded into the system hardware colormap, both application windows 11 and 12 would have color focus and would display colors as expected. In the case in which a window 13 creates its own private colormap which is subsequently loaded into the color table hardware, it will have color focus.

In one type of computer system, changes in color focus occurs at the same time as changes in user focus (depending on the currently loaded colormap). For instance, if a user drags the screen cursor to an application's window and begins to interact with it (i.e. the user changes user focus), the window management system automatically loads the user focused application's colormap into the system hardware map (if it is not already loaded) and that application has color focus. In contrast, in a second type of system, the user must explicitly indicate to the window management software which colormap is to have color focus, no matter which application window has user focus.

FIG. 2 illustrates a typical indexed color table. The table contains red, green, and blue (i.e. RGB) fields or columns. A row of the color table is called a color cell—each cell containing one entry for each red, green, and blue color value. Other types of color tables may have more or less fields, different bit widths, or different color values (such as CMYK) than that shown in FIG. 2. The particular RGB color values within the color table are represented in hexadecimal numbers. However, these color values may be represented in many other digital number formats.

Each color cell defines a unique color within the table such that the number of color cells in a given table corresponds to the number of possible colors that the table can provide. For most types of color displays, a pixel index value is used to index directly into the color table. If the color of an area within the screen, (such as background area 14, FIG. 1) is designated to be colorized by a given pixel index, then the color displayed for area 14 is whatever color is stored at that particular indexed location stored in the color table hardware of the computer system. For instance assume that area 14 is designated to be colorized with the color value stored at the pixel 3 index location. If color table 20 (FIG. 2) is currently loaded, then area 14 is colorized by color table 20's pixel 3 color value, i.e. red (0×0000), green (0×0000), and blue (0×ffff). This color value corresponds to the color blue (i.e. red and green off, blue full scale).

In the case in which many applications use the same colormap, such as a default colormap, no colorflashing occurs since only one colormap is being used. However, when an application creates a private colormap that is significantly different from the currently loaded colormap, and this private map is loaded into the system hardware, colorflashing will occur. For instance, if windows 11 and 12 are using a default colormap which is currently loaded into the colormap hardware, screen 10 will be colored in the manner defined by the default colormap. Specifically, area 14 will be colorized by the default color value stored in a given pixel index location stored within the hardware colormap. If color focus changes from window 11 or 12 to window 13, (which in some systems might occur when the user drags the cursor from window 11 or 12 to window 13), window 13's private colormap is loaded into the hardware colormap. As a result, a new value may be loaded into the given pixel index location colorizing area 14, causing area 14 to flash to a different color (i.e. colorflash). It should be noted that if the computer system had the hardware capability to store all of the colormaps, then, colorflashing would not occur.

The present invention is a method for maintaining color fidelity in a computer system supporting multiple colormaps and in which the computer system's hardware is incapable of storing all of the multiple colormaps. A first method of the present invention, referred to as residual color allocation, is implemented by copying color values from a private colormap into free cells of a shared default map (at the same pixel location). After copying, the cells are again given a "free" status so that other applications, also referred to as clients, may copy their values into the shared default colormap cell locations as necessary. The purpose of this method is to keep the color values of as many private colormap cells as possible the same as the color value definitions of the shared default colormap. By ensuring that the private and default maps having very few non-synchronized color values, minimal colorflashing is exhibited.

The following steps describes what is performed during one embodiment of the residual color allocation technique of the present invention.

1. allocate for read/write access all free cells in the default colormap and define these as freecells;
2. for each cell in freecells copy the color RGB definition from the private colormap into the cell;
3. store the modified freecells back into the default colormap;
4. free the freecells (in order to release the cells for other clients to use);

FIG. 3A illustrates a private client colormap and FIG. 3B illustrates a shared default colormap before the method of residual color allocation of the present invention is performed. As shown, the private colormap (FIG. 3A) contains pixel 0—N-1 and their corresponding color values. For example, the color value for pixel 0 is R:0×fff, G:0×fff, and B:0×fff. The default colormap (FIG. 3B) includes a column, referred to as "Free", in addition to pixel and color values. This column defines the status of each cell in terms of its availability to be allocated. The "n" in the Free column indicates that these cells are already allocated, i.e. reserved, and thus cannot be changed or reserved. The "-" in the allocated cells simply indicates color values stored within these allocated cells. The "y" in the Free column indicates that these cells are allocatable (or free for allocation). Note that the free cells are undefined in the default colormap shown in FIG. 3B. FIG. 3B shows that pixels 0–3, 7, and 8 are the only non-allocatable color cells in the default colormap. The remainder of the color cells, i.e. pixels 4–6, 9—(N-1), are all allocatable, i.e. free to be reserved and changed.

FIGS. 4A and 4B illustrate the private and default colormaps shown in FIGS. 3A and 3B after steps 1–3 (as described above) have been performed. The "X" in the Free column in FIG. 4B indicates that the cells are temporarily allocated read-write (step 1). In step 2, the RGB color value in the private map is copied into a corresponding freecell within the default colormap. Finally, in step 3, the RGB definitions from the private colormap is stored in the default colormap as indicated by the "→" between the colormaps.

FIGS. 5A and 5B illustrate the private and default colormaps after performing residual color allocation. As can be seen, the updated cells within the default colormap have been "freed", as shown in FIG. 5B, by setting the status of the free cells to "y". This allows other clients to allocate these cells if so desired. Note that the RGB definitions in the default colormap for the free cells are identical to the corresponding cells in the private map. These cells will not colorflash when changing color focus between the two maps shown in FIGS. 5A and 5B.

It is important to note that in the case in which N=256, a very small percentage of the total number of colors in each table shown in FIGS. 5A and 5B differ, and as a consequence, colorflash. Specifically, in this example, 250 out of 256 color cells are identical resulting in a 97.6% non-flashing cells.

A second technique of the present invention, referred to as default colormap sharing, is implemented by copying color cell definitions of the allocated cells in the default colormap into a private colormap. This technique can be employed when a client does not require a specific set of colors and can adapt to a given set of colors.

One embodiment of the default colormap sharing technique of the present invention is performed in the following steps:

1. get a list of all cells that are allocated in the default colormap and define as allocatedcells;
2. for each cell in allocatedcells list copy the color cell's RGB definition from the defaultcolormap into the corresponding cell within the private colormap.

FIGS. 6 and 7 illustrate the default colormap sharing technique of the present invention. FIGS. 6A and 6B illustrate private and default colormaps prior to the default colormap sharing technique. As was previously described the "-" in all of the free pixel locations indicate a color value stored within these cells. FIGS. 6A and 6B illustrate that the defined color values for the default map's allocated cells, i.e. pixels 0–3,7, and 8 are different from the corresponding index location color values in the private colormap.

To perform default colormap sharing according to the present invention, allocated default colormap cells, (pixels 0–3,7, and 8) are copied from the default colormap (FIG. 6B) to corresponding locations within the private colormap shown in FIG. 6A. FIGS. 7A and 7B illustrate colormaps 6A and 6B after default colormap sharing is performed where "←" indicates copying step 2 (as describe above). As shown in FIGS. 7A and 7B the color values in pixel index locations 0–3,7, and 8 are identical for both colormaps. Consequently no colorflashing occurs when color focus changes between a client using the default colormap shown in FIG. 7B and a client using the private colormap shown in FIG. 7A for display colors designated to be colorized by these pixel index locations.

A third technique of the present invention is to use both residual color allocation and default colormap sharing simultaneously. In this case, color values from the private map are copied into all of the default colormap's corresponding free cell locations (as indicated by →) and color values from the allocated cells in the default colormap are copied into corresponding cells within the private colormap (as indicated by ←), (as illustrated in FIG. 8). As can be seen in FIG. 8, residual color allocation is implemented on cells corresponding to pixel index locations 4–6, 9—(N-1) and default colormap sharing is implemented on cells corresponding to pixel index locations 0–3, 7, and 8. Since the private and default colormaps are identical no colorflashing occurs when color focus transitions between a client using the private colormap and a client using the default colormap.

The color allocation and/or default colormap sharing techniques described above are generally implemented at the time in which a client is defining its private colormap color values which often occurs when the application window is initially opened (i.e. when the application window is initially displayed on the screen). The present invention's techniques may be subsequently implemented on an "as required" basis as a user redefines color values within a given private colormap.

It should be noted that applications that are run on a given operating system frequently employ the system's default colormap. And further, only one client usually employs a private colormap. In this situation, colorflashing is reduced significantly since the default colormap and the one private colormap may be synchronized using the residual color allocation and default color sharing techniques of the present invention as described above. In this case, colorflashing will only occur when an allocated cell cannot be copied to the private map since the private map may require a particular color for that cell location.

The present invention can also be employed in a situation in which multiple private colormaps are employed. For instance, in this case when a first given client (employing a first private colormap) defines/redefines its map's color values and performs the above described techniques colorflashing is minimized for color focus transitions between the first client and a client using the default colormap. In the case in which a second client (having a second private colormap) subsequently defines/redefines its colormap values and performs the colorflash reduction techniques of the present invention, colorflashing is reduced for color focus transitions between the second client and the default map client. In this state, however, the default map is synchronized with the second client's private colormap—not the with the first client's private colormap. Consequently, if color focus subsequently transitions from the default colormap (which is synchronized to the second client's colormap) back to the first client, colorflashing can occur. In this case, the colorflashing reduction technique of the present invention will need to be performed again between the first private map and the default map. It should be noted that colorflashing may occur when color focus directly transitions between the first and second client's private colormaps.

Although the elements of the present invention have been described in conjunction with a certain embodiment, it is appreciated that the invention may be implemented in a variety of other ways. Consequently, it is to be understood that the particular embodiment shown and described by way of illustration are in no way intended to be considered limiting. Reference to the details of these embodiments is not intended to limit the scope of the claims which themselves recite only those features regarded as essential to the invention.

I claim:

1. A method for reducing color flashing when changing color focus between first and second colormaps in a computer system having a screen and a means for storing sets of color values, said computer system displaying a first area in said screen corresponding to a first application, said first application employing said first colormap, said screen also displaying a second area corresponding to a second application, said second application employing said second colormap, said first colormap having a first set of color values with associated index locations and said second colormap having a second set of color values with said associated index locations, said method comprising the steps of:

1) identifying allocatable index locations in said first colormap's associated index locations;

2) changing said identified allocatable index locations to temporarily allocated index locations;

3) copying color values having corresponding index locations as said temporarily allocated index locations from said second colormap into said allocated index locations of said first colormap so as to minimize differences between said first and second colormaps wherein said first colormap comprises said copied color values from said second colormap and a portion of said first set of color values;

4) changing said temporarily allocated index locations to allocatable index locations in said first colormap.

2. The method as described by claim 1 wherein said first colormap is a default colormap provided by said computer system and said second colormap is a private-type colormap created by said second application.

3. The method as described by claim 2 wherein each of said color values is a combination of a red color value, a green color value and a blue color value.

4. The method as described by claim 3 wherein it is implemented when said second application defines said second set of color values.

5. The method as described in claim 3 wherein it is implemented when said second application redefines at least one of said second set of color values.

6. A method for reducing color flashing when changing color focus between first and second colormaps in a computer system having a screen and a means for storing sets of color values, said computer system displaying a first area in said screen corresponding to a first application, said first application employing said first colormap, said screen also displaying a second area corresponding to a second application, said second application employing said second colormap, said first colormap having a first set of color values with associated index locations and said second colormap having a second set of color values with said associated index locations, said method comprising the steps of:

1) identifying allocated index locations in said first colormap's associated index locations;

2) copying color values from said allocated index locations of said first colormap into corresponding index locations in said second colormap so as to minimize differences between said first and second colormaps wherein said second colormap comprises said copied color values from said first colormap and a portion of said second set of color values.

7. The method as described by claim 6 wherein said first colormap is a default colormap provided by said computer system and said second colormap is a private-type colormap created by said second application.

8. The method as described by claim 7 wherein each of said color values is a combination of a red color value, a green color value and a blue color value.

9. The method as described by claim 8 wherein it is implemented when said second application defines said second set of color values.

10. The method as described in claim 8 wherein it is implemented when said second application redefines at least one of said second set of color values.

11. A method for reducing color flashing when changing color focus between first and second colormaps in a computer system having a screen and a means for storing sets of color values, said computer system displaying a first area in said screen corresponding to a first application, said first application employing said first colormap, said screen also displaying a second area corresponding to a second application, said second application employing said second colormap, said first colormap having a first set of color values with associated index locations and said second colormap having a second set of color values with said associated index locations, said method comprising the steps of:

1) identifying allocatable index locations and allocated index locations in said first colormap's associated index locations;

2) changing said identified allocatable index locations to temporarily allocated index locations;

3) copying color values having corresponding index locations as said temporarily allocated index locations from said second colormap into said temporarily allocated index locations of said first colormap so as to minimize differences between said first and second colormaps wherein said first colormap comprises said copied color values from said second colormap and a portion of said first set of color values;

4) copying color values from said allocated index locations of said first colormap into corresponding index locations in said second colormap wherein said second colormap comprises said copied color values from said first colormap and a portion of said second set of color values;

5) changing said temporarily allocated index locations to allocatable index locations in said first colormap.

12. The method as described by claim 11 wherein said first colormap is a default colormap provided by said computer system and said second colormap is a private-type colormap created by said second application.

13. The method as described by claim 12 wherein each of said color values is a combination of a red color value, a green color value and a blue color value.

14. The method as described by claim 13 wherein it is implemented when said second application defines said second set of color values.

15. The method as described in claim 13 wherein it is implemented when said second application redefines at least one of said second set of color values.

* * * * *